US011781816B2

(12) United States Patent
Mao

(10) Patent No.: US 11,781,816 B2
(45) Date of Patent: Oct. 10, 2023

(54) HETERO-MATERIAL FLOATING HEAT PIPE STRUCTURE

(71) Applicant: ASIA VITAL COMPONENTS (CHINA) CO., LTD., Shenzhen (CN)

(72) Inventor: Chun-Lin Mao, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 0 days.

(21) Appl. No.: 17/561,725

(22) Filed: Dec. 24, 2021

(65) Prior Publication Data

US 2023/0204301 A1 Jun. 29, 2023

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... H05K 7/20963; H05K 7/20336; H05K 7/20436; H05K 7/20; H05K 5/0086; G04F 17/00; F28D 15/2033; F28D 15/046; F28D 15/04; F28D 15/0241; F28D 15/0275; F28D 15/02
See application file for complete search history.

(56) References Cited

U.S. PATENT DOCUMENTS

2008/0099186 A1* 5/2008 Yu ..... F28D 15/046 165/104.11
2017/0017279 A1* 1/2017 Saeidi ..... G04G 17/02

FOREIGN PATENT DOCUMENTS

CN 105658021 A * 6/2016
JP S63120188 U * 8/1988
TW 200815724 A 4/2008
TW 201128156 A 8/2011
TW 625188 U 4/2022

OTHER PUBLICATIONS

Search Report dated Mar. 2, 2023 issued by Taiwan Intellectual Property Office for counterpart application No. 110144433, 2 pages.

* cited by examiner

*Primary Examiner* — Harry E Arant
(74) *Attorney, Agent, or Firm* — Bradley J. Thorson; DeWitt LLP

(57) ABSTRACT

A hetero-material floating heat pipe structure includes a main body and a multi-segment floating adjustment unit. The main body has a front end, a rear end and a flexible section disposed between the front end and the rear end. The flexible section has flexibility, whereby the main body is flexible. The multi-segment floating adjustment unit is disposed on an outer surface of the flexible section for restricting and protecting the flexible section. The multi-segment floating adjustment unit includes multiple adjustment members, which are pivotally connected with each other and stringed to form the multi-segment floating adjustment unit. Each of two ends of each adjustment member has a pivoted section. By means of the pivoted sections, the adjustment members are pivotally connected with each other and can be swung and bent by the same angle or by different angles to adjust the arrangement of the multi-segment floating adjustment unit.

3 Claims, 5 Drawing Sheets

HETERO-MATERIAL FLOATING HEAT PIPE STRUCTURE

BACKGROUND OF THE INVENTION

1. Field of the Invention

The present invention relates generally to a heat pipe structure, and more particularly to a hetero-material floating heat pipe structure.

2. Description of the Related Art

A conventional heat pipe is a component with high heat conductivity. A working fluid inside the heat pipe serves to absorb heat. Thereafter, the working fluid is transformed from liquid phase into vapor phase so as to transfer the heat. The heat pipe can work to provide very great heat transfer amount at very small temperature difference without any external power supply. The conventional heat pipe structure mainly includes three major parts, that is, sealed chamber, capillary structure and working liquid. The heat pipe works mainly in a condition of vacuumed environment. Therefore, the heat pipe necessitates a well sealed space. The capillary structure is a structure easy to transfer the working fluid. With respect to the function, the chamber can be divided into three sections, that is, evaporator section, adiabatic section and condenser section. The heat pipe works in a principle that the evaporator section of the chamber is heated, whereby the working fluid contained in the capillary structure of the evaporator section absorbs heat and is transformed from liquid phase into vapor phase. The vapor pressure produced by the vapor drives the vapor to flow through the adiabatic section to the condenser section with lower pressure. After reaching the condenser section, the vapor releases the absorbed latent energy and is condensed back into working liquid. Then, under the capillary attraction of the capillary structure, the working liquid is sent back to the evaporator section. Accordingly, the heat transfer cycle is continuously repeated.

Moreover, the flat-plate heat pipe has a structure similar to that of the conventional tubular heat pipe. The flat-plate heat pipe also includes a metal-made sealed chamber, capillary structure and working fluid. The working principle of the flat-plate heat pipe is also identical to that of the conventional heat pipe. The greatest difference between the flat-plate heat pipe and the conventional heat pipe is that the bottom section of the flat-plate heat pipe has a larger area than the conventional heat pipe, which can only one-dimensionally transfer heat. Therefore, the bottom section of the flat-plate heat pipe can fully attach to a heat source. In the heat transfer process, this helps the heat dissipation component to keep uniformity of temperature and lower the thermal resistance of the bottom section of the heat dissipation component so as to enhance heat dissipation performance.

However, the packaging structures of all the heat sources on the circuit board of an electronic device have the problem of height difference (non-uniform heights). As a result, height differences exist between all the heat sources. Therefore, when the evaporator sections of all the heat pipes of a thermal module are in contact with the heat sources by lap joint or in connection with the heat sink, the evaporator sections are positioned at different heights. Such connection of height difference will lead to deterioration of heat transfer efficiency of the heat pipe or even failure of the heat pipe. This is because the entire tubular body of the heat pipe is made of a metal sheet material with the same thickness. Therefore, the evaporator section, adiabatic section and condenser section of the heat pipe have conformable thickness. When it is necessary to adjust the height difference between the evaporator section and the condenser section in adaptation to the height differences between the heat sources, due to the properties of metal material and the conformity of the thickness of the sheet material, in case the adiabatic section is flexed or bent to meet the height difference requirement, the bridging force between the evaporator section and the condenser section of the heat pipe will make the evaporator section and the condenser section pull each other. As a result, the adiabatic section (transmission section) will be inward compressed or outward drawn and deformed. This will lead to breakage of the capillary structure in the heat pipe and damage of the tubular wall of the heat pipe. This will cause deterioration of the heat transfer efficiency or even failure of the heat pipe.

To solve the above problem, a flexible heat pipe has been developed, in which the height difference between the evaporator section and the condenser section is adjustable. However, the conventional flexible heat pipe has a bellows structure or a flexible section connected between the evaporator section and the condenser section of the heat pipe. The flexible section has thinner tubular wall so that the flexible section can be bent. However, when flexing the bellows structure or the flexible section with thinner tubular wall, crimp interference will take place so that the flexible section can be only bent by one angle or in one direction. As a result, the bending angle of the flexible section can be adjusted only in accordance with the highest electronic component. Therefore, the conventional flexible heat pipe cannot be flexed by different angles or in different directions in adaptation to the arrangement of multiple heat sources or mechanisms with height differences. Accordingly, it is inconvenient to use or apply the conventional flexible heat pipe.

It is therefore tried by the applicant to provide a hetero-material floating heat pipe structure to solve the above problems existing in the conventional heat pipe structure.

SUMMARY OF THE INVENTION

It is therefore a primary object of the present invention to provide a hetero-material floating heat pipe structure including a main body and a multi-segment floating adjustment unit. The main body has a flexible section made of a material different from the material of the other parts of the main body. The multi-segment floating adjustment unit includes multiple adjustment members, which are disposed on the outer surface of the flexible section for restricting and protecting the flexible section.

It is a further object of the present invention to provide the above hetero-material floating heat pipe structure, in which the multi-segment floating adjustment unit includes multiple adjustment members, which are positioned on the outer surface of the flexible section of the heat pipe. The adjustment members are pivotally connected and stringed by means of pivoted sections between the adjustment members, whereby the adjustment members can be swung and bent by the same angle or by different angles to adjust the arrangement of the multi-segment floating adjustment unit.

To achieve the above and other objects, the hetero-material floating heat pipe structure of the present invention includes a main body and a multi-segment floating adjustment unit. The main body has a front end, a rear end and a flexible section. The flexible section is disposed between the front end and the rear end in connection therewith. The front end and the rear end are made of metal material. The flexible section is made of plastic material or polymer material. A heat transfer chamber is defined in the main body. The heat transfer chamber extends from the front end through the flexible section to the rear end. The multi-segment floating adjustment unit has multiple adjustment members disposed on an outer surface of the flexible section for restricting and protecting the flexible section. Each of two ends of each adjustment member has at least one pivoted section for pivotally connecting the adjustment members with each other so as to string the adjustment members to form the multi-segment floating adjustment unit, whereby by means of the pivoted sections, the adjustment members can be swung and bent by the same angle or by different angles to adjust the arrangement of the multi-segment floating adjustment unit.

In the above hetero-material floating heat pipe structure, the front end and the rear end are made of the same metal material or different metal materials.

In the above hetero-material floating heat pipe structure, the polymer material is selected from a group consisting of polypropylene, polyethylene, polystyrene, polyimide and polyethylene terephthalate.

In the above hetero-material floating heat pipe structure, each pivoted section is formed with a pivot hole and at least one pivot member is passed through the corresponding pivot holes to pivotally connect the pivoted sections.

In the above hetero-material floating heat pipe structure, any of the pivoted sections is formed with a pivot hole, while the other of the pivoted sections is formed with a protruding shaft in adaptation to the pivot hole.

In the above hetero-material floating heat pipe structure, the front end has a front end inner space and the rear end has a rear end inner space, while the flexible section has a flexible inner space. The front end inner space, the rear end inner space and the flexible inner space are in communication with each other to form the heat transfer chamber. A first capillary structure is disposed in each of the front end inner space and the rear end inner space. A second capillary structure is disposed in the flexible inner space. A working liquid is filled in the heat transfer chamber.

In the above hetero-material floating heat pipe structure, the first capillary structure is selected from a group consisting of channels, powder sintered body, mesh body, fiber body and waved plate, while second capillary structure is selected from a group consisting of channels, mesh body, fiber body and waved plate body.

In the above hetero-material floating heat pipe structure, at least one adjustment member positioned at at least one end of the multi-segment floating adjustment unit is connected with any or both of the front section and the rear section of the main body.

In the above hetero-material floating heat pipe structure, the multi-segment floating adjustment unit has at least one locating member positioned at at least one end of the multi-segment floating adjustment unit to connect with any or both of the front section and the rear section of the main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
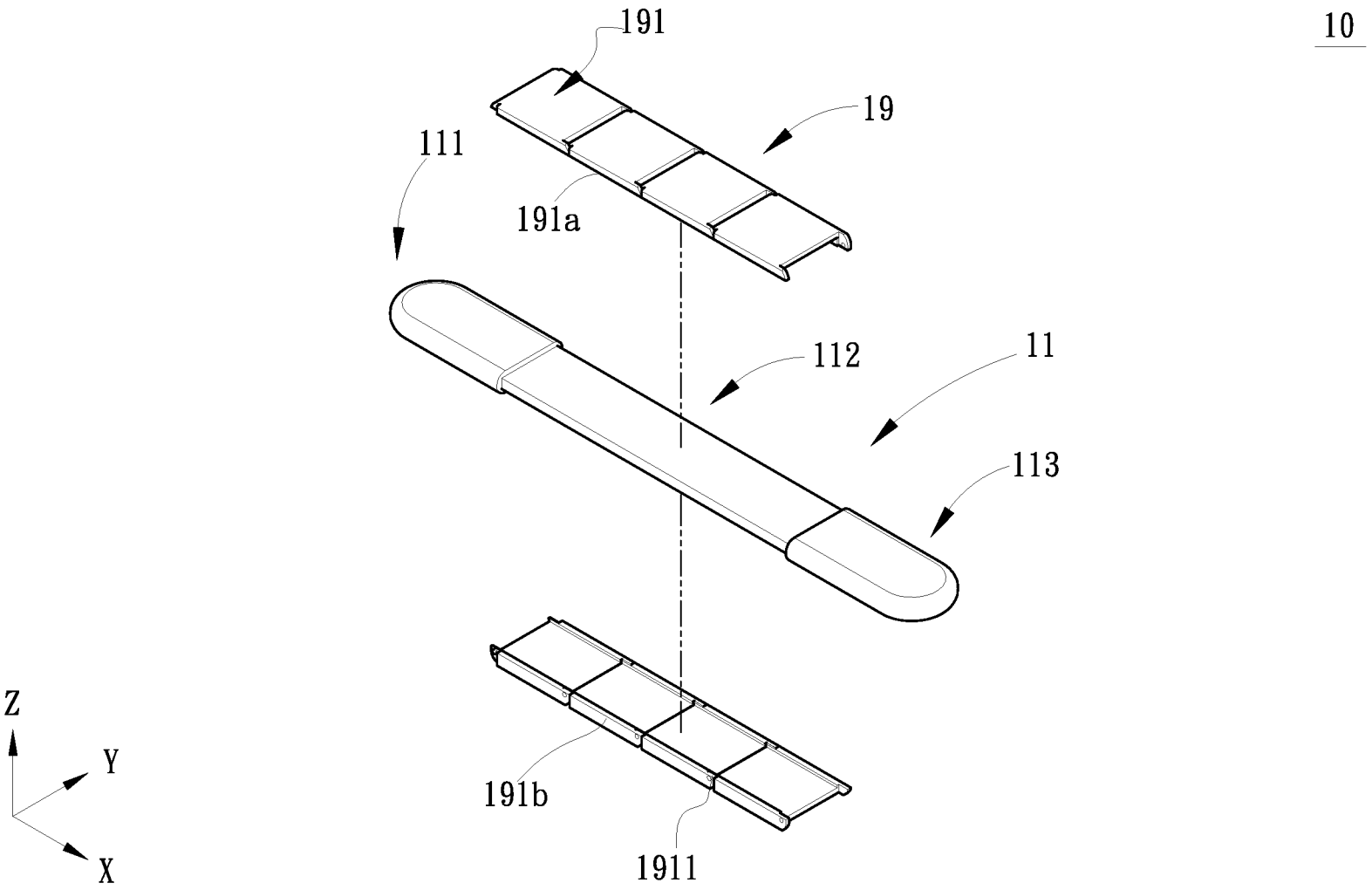
FIG. 1 is a perspective exploded view of the present invention.
Figure 2:
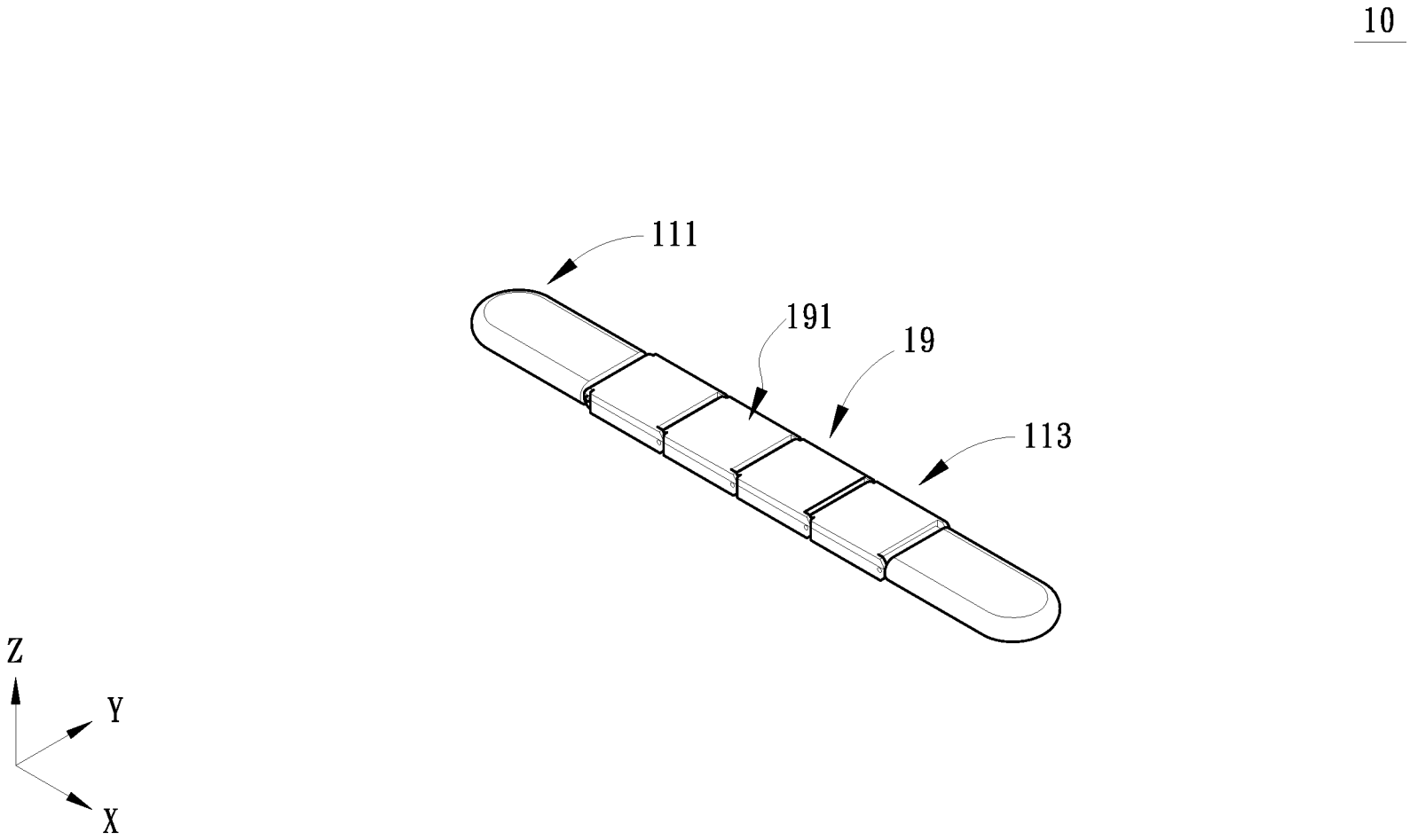
FIG. 2 is a perspective assembled view of the present invention.
Figure 3:
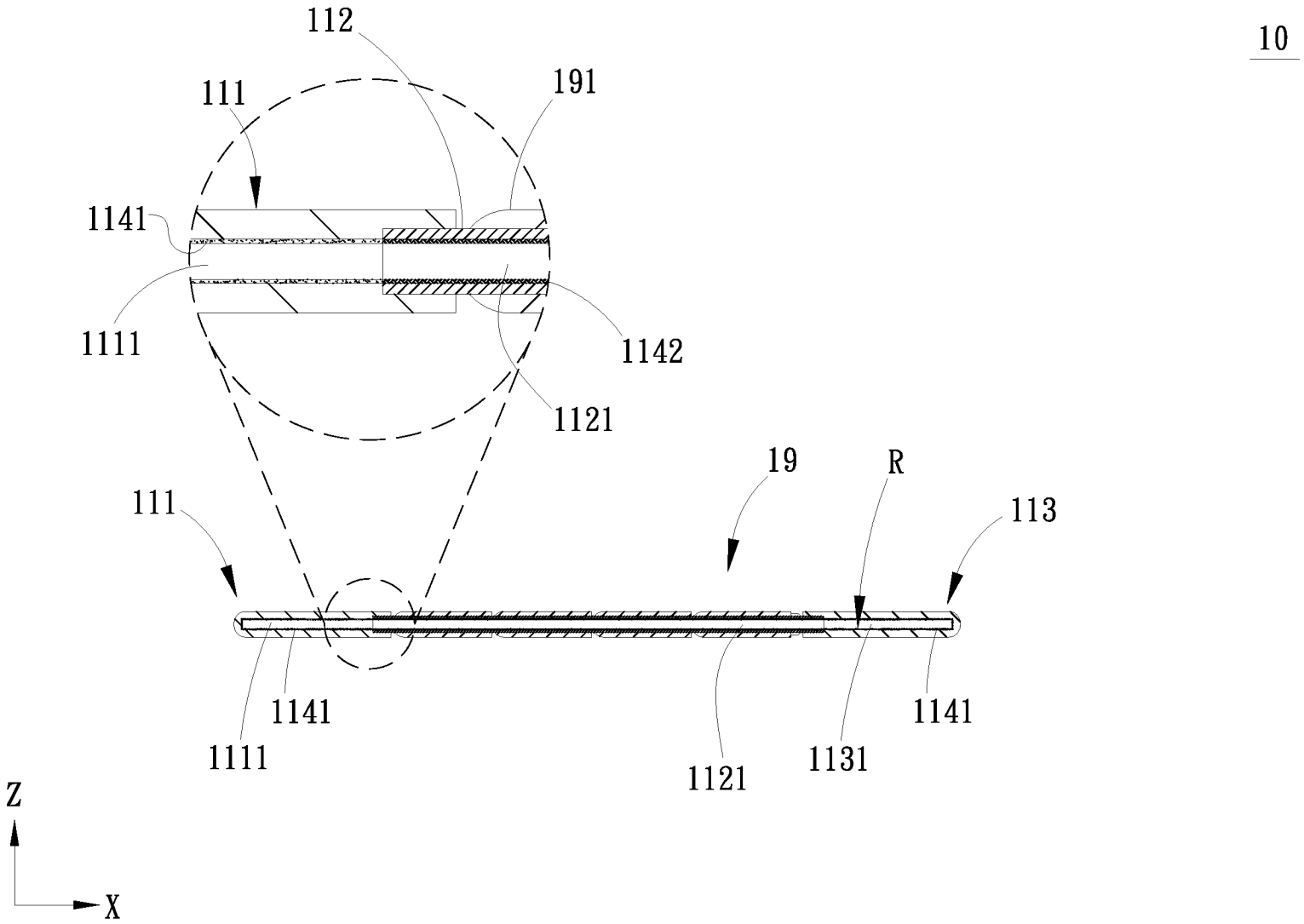
FIG. 3 is a sectional assembled view of the present invention.

Please refer to FIGS. 1, 2 and 3. FIG. 1 is a perspective exploded view of the present invention. FIG. 2 is a perspective assembled view of the present invention. FIG. 3 is a sectional assembled view of the present invention. As shown in the drawings, the heat pipe structure 10 (such as a circular heat pipe, a D-shaped heat pipe or a flat-plate heat pipe) of the present invention includes a main body 11 and a multi-segment floating adjustment unit 19. The main body 11 has a front end 111, a flexible section 112 and a rear end 113. The front end 111 and the rear end 113 are outer cases made of the same metal material or different metal materials. (The outer cases are such as, but not limited to, the flat-plate case bodies as shown in the drawings. Alternatively, the outer cases can be circular case bodies or D-shaped case bodies or otherwise geometrically configured case bodies). The front end 111 and the rear end 113 respectively serve as an evaporator section and a condenser section. The flexible section 112 is made of polymer material or plastic material and serves as an adiabatic section disposed between the front end 111 and the rear end 113 in connection therewith. The multi-segment floating adjustment unit 19 is disposed on an outer surface of the flexible section 112 and substantially positioned between the front end 111 and the rear end 113. The detailed structure of the multi-segment floating adjustment unit 19 will be described hereinafter.

The metal material of the front end 111 and the rear end 113 is selected from a group consisting of gold, silver, copper, aluminum, iron, stainless steel, titanium, commercial pure titanium, titanium alloy, copper alloy and aluminum alloy. The polymer material or plastic material of the flexible section 112 is selected from a group consisting of polypropylene (PP), polyethylene (PE), polystyrene (PS), polyimide (PI) and polyethylene terephthalate (PET). The flexible section 112 is selectively made of the polymer material or plastic material so that the flexible section 112 is durable against many times of bending and the flexural strength of the flexible section 112 is enhanced to prevent the flexible section 112 from fissuring and damaging.

The front end 111 has a front end inner space 1111 and the rear end 113 has a rear end inner space 1131, while the flexible section 112 has a flexible inner space 1121. The front end inner space 1111, the rear end inner space 1131 and the flexible inner space 1121 are in communication with each other to form a heat transfer chamber R inside the main body 11. That is, the heat transfer chamber R extends from the front end 111 through the flexible section 112 to the rear end 113. A working liquid is filled in the heat transfer chamber R.

A first capillary structure 1141 is disposed in each of the front end inner space 1111 and the rear end inner space 1131.

The first capillary structure 1141 is selected from a group consisting of channels, powder sintered body, mesh body, fiber body and waved plate. A second capillary structure 1142 is disposed in the flexible inner space 1121. The second capillary structure 1142 is selected from a group consisting of mesh body, fiber body, waved plate body and plate material having a surface with recessed and raised sections in adaptation to the flexion state of the flexible section 112.

Moreover, in this embodiment, two ends of the flexible section 112 respectively extend into the front end inner space 1111 and the rear end inner space 1131 and the second capillary structure 1142 of the flexible section 112 is in flush contact or connection with the first capillary structure 1141 (as shown in FIG. 3). In a modified embodiment, the second capillary structure 1142 of the flexible section 112 has an extension section overlapped with the first capillary structure 1141 and in contact or connection with the first capillary structure 1141. Accordingly, the flexible section 112 is in capillary communication with the front end 111 and the rear end 113. The term "capillary communication" means a liquid can flow from a capillary structure to another capillary structure under capillary attraction.

The working fluid in the heat transfer chamber R is heated at the front end 111 and evaporated from liquid phase into vapor phase. The vapor flows through the flexible section 112 to the rear end 113. Then the heat of the vapor is dissipated at the rear end 113, whereby the vapor is condensed into the liquid phase. Then the liquid flows back to the front end 111 by means of the first and second capillary structures 1141, 1142. Accordingly, the working fluid in the heat transfer chamber R is circularly changed between liquid phase and vapor phase so as to achieve heat transfer and heat dissipation effect.

Figure 4:
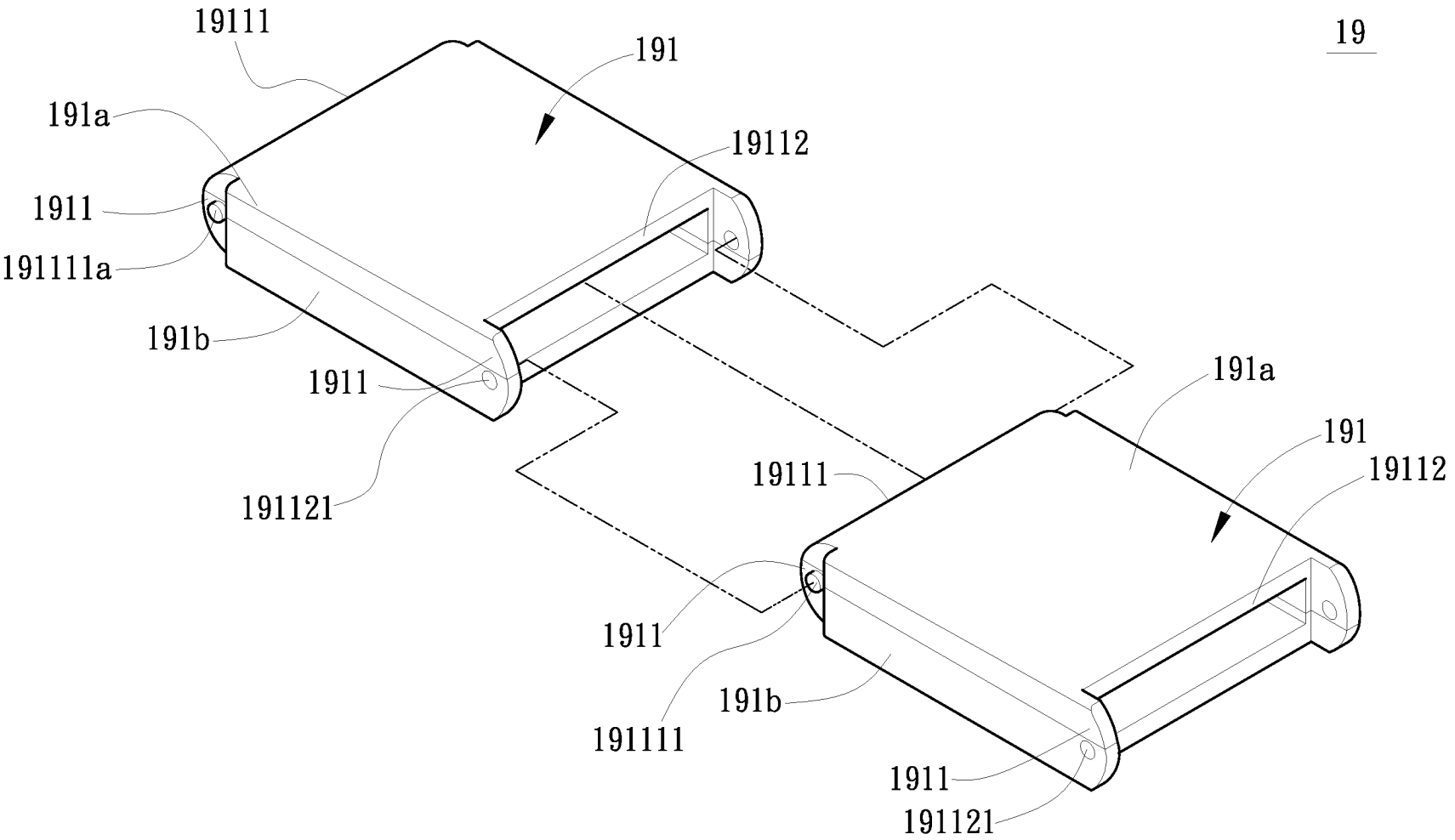
FIG. 4 is a perspective view showing a part of the multi-segment floating adjustment unit of the present invention.

Please further refer to FIG. 4, which is a perspective view showing a part of the multi-segment floating adjustment unit of the present invention. Also referring to FIGS. 1 to 3, the multi-segment floating adjustment unit 19 has multiple adjustment members 191 arranged along the flexible section 112 in adjacency to each other. The adjustment members 191 are arranged at equal intervals or unequal intervals. In this embodiment, four adjustment members 191 are, but not limited to, arranged at equal intervals. In practice, the number and intervals of the adjustment members 191 can be increased or decreased in accordance with the length of the flexible section 112. Each of two ends of each adjustment member 191 has a pivoted section 1911. The corresponding pivoted sections 1911 of each two adjacent adjustment members 191 are pivotally connected to string the adjustment members 191, whereby the adjustment members 191 together form a multi-segment pivotally connected structure, which can be swung and bent. Each adjustment member 191 has an upper portion 191*a* and a lower portion 191*b*, whereby the flexible section 112 is enclosed in the multi-segment floating adjustment unit 19 (as shown in FIGS. 1 to 3).

Each adjustment member 191 has two ends as a front side 19111 and a rear side 19112. The front side 19111 and the rear side 19112 are respectively provided with the pivoted sections 1911. In this embodiment, the pivoted sections 1911 are male and female structures in adaptation to each other. The pivoted section 1911 of the front side 19111 of an adjustment member 191 is correspondingly pivotally connected with the pivoted section 1911 of the rear side 19112 of an adjacent adjustment member 191. Accordingly, by means of the pivoted sections 1911 between the adjacent adjustment members 191, the adjustment members 191 of the multi-segment floating adjustment unit 19 can be swung and bent by different angles or the same angle so as to adjust the arrangement of the multi-segment floating adjustment unit 19.

In this embodiment, any of the pivoted sections 1911 of each adjustment member 191 is formed with a pivot hole 191121, while the other of the pivoted sections 1911 is formed with a protruding shaft 191111*a* correspondingly pivotally connected with the pivot hole 191121 as a means for pivotally connecting the adjustment members 191 to string the adjustment members 191 into the multi-segment floating adjustment unit 19. As shown in the drawings, the pivoted section 1911 of the front side 19111 of the adjustment member 191 is formed with a protruding shaft 191111*a*, while the pivoted section 1911 of the rear side 19112 is formed with a pivot hole 191121 in adaptation to the protruding shaft 191111*a*. The protruding shaft 191111*a* is pivotally connected with the pivot hole 191121. Accordingly, the pivoted sections 1911 of two adjacent adjustment members 191 are connected by means of press fit so that a proper securing force and securing torque are provided for the two adjacent adjustment members 191 so as to locate the adjustment members 191 after swung and bent. Alternatively, a washer (such as a torque washer, metal washer or frictional washer) can be selectively disposed between the pivoted sections 1911 to provide extra securing force and securing torque for the two adjacent adjustment members 191.

In a modified embodiment, the pivoted sections 1911 of the two adjacent adjustment members 191 are formed with corresponding pivot holes and at least one pivot member (such as a pivot shaft or pivot pin) is passed through the corresponding pivot holes as a means for pivotally connecting the pivoted sections 1911 to string the adjustment members 191 into the multi-segment floating adjustment unit 19. Accordingly, the pivoted sections 1911 of the two adjacent adjustment members 191 are pivotally connected by means of the pivot member so that a proper locating force is provided for the two adjacent adjustment members 191 so as to locate the adjustment members 191 after swung and bent. Therefore, the multi-segment floating adjustment unit 19 can be swung and bent by different angles or the same angle so as to adjust the arrangement of the multi-segment floating adjustment unit 19.

The above embodiments disclose some means for pivotally connecting the pivoted sections of the adjacent adjustment members to string the adjustment members into the multi-segment floating adjustment unit for illustration purposes. However, the means for pivotally connecting the pivoted sections of the adjacent adjustment members is not limited to above embodiments. For example, any means of physical structure or mechanical structure or electronic/electrical structure or a combination thereof that can movably pivotally connect two adjacent adjustment members 191 to string the adjustment members 191 into the multi-segment floating adjustment unit 19 and make the two adjacent adjustment members 191 swung and bent by different angles or the same angle to adjust the arrangement of the multi-segment floating adjustment unit 19 should be included in the scope of the present invention.

Furthermore, the flexible section 112 is made of polymer material or plastic material so that the flexible section 112 has flexibility and can be properly bent. The multi-segment floating adjustment unit 19 serves to restrict the flexible section 112, whereby the flexible section 112 can be swung and bent along with the adjacent adjustment members 191 to adjust the angle and the arrangement of the multi-segment floating adjustment unit 19. Moreover, the flexibility of the flexible section 112 makes the flexible section 112 lack hardness and subject to damage. Therefore, the flexible section 112 is enclosed in the multi-segment floating adjustment unit 19 as a protection case for protecting and preventing the flexible section 112 from being abraded, thrust or cut off by a hard and/or sharp object.

In addition, the adjustment members 191 of the multi-segment floating adjustment unit 19 are disposed on the outer surface of the flexible section 112 by a connection means. Alternatively, the adjustment member 191 positioned at at least one end of the multi-segment floating adjustment unit 19, (such as the adjustment member 191 at any or both of the leftmost end and the rightmost end) is connected with any or both of the front section 111 and the rear section 113 of the main body 11 by a connection means (such as adhesion, welding, clamping, engagement or fitting). Therefore, the multi-segment floating adjustment unit 19 can be positioned on the outer surface of the flexible section 112. By means of such arrangement, when the multi-segment floating adjustment unit 19 is swung to adjust the angle, the multi-segment floating adjustment unit 19 is prevented from displacing and detaching from the flexible section 112 due to the swing.

Figure 5:
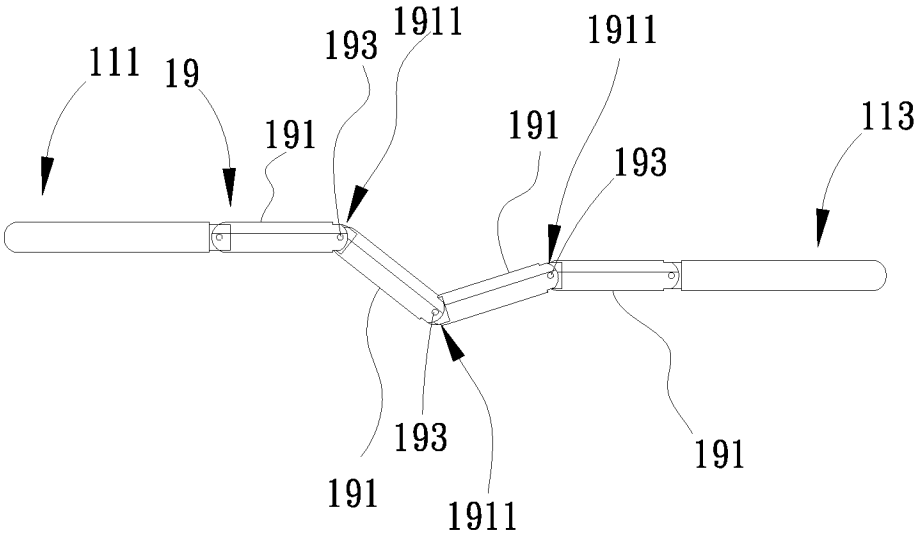
FIG. 5 is a side view of the present invention, showing that the present invention is swung and bent by different angles or by the same angle so as to adjust the arrangement of the present invention.

Please further refer to FIG. 5, which is a side view of the present invention, showing that the present invention is swung and bent by different angles or by the same angle so as to adjust the arrangement of the present invention. Also referring to FIGS. 1 to 3 and FIGS. 4, by means of the pivoted sections 1911 between the adjustment members 191 of the multi-segment floating adjustment unit 19, the adjacent adjustment members 191 can be swung and bent by different angles or by the same angle so as to adjust the arrangement of the present invention. As shown in the drawings, the multi-segment floating adjustment unit 19 is such as, but not limited to, bent by means of relatively swinging the first and second adjustment members 191, relatively swinging the second and third adjustment members 191 and relatively swinging the third and fourth adjustment members 191 so as to adjust the angle. The flexible section 112 enclosed in the multi-segment floating adjustment unit 19 is restricted to be swung and bent along with the multi-segment floating adjustment unit 19.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A hetero-material floating heat pipe structure comprising:

a main body having a front end, a rear end and a flexible section, the flexible section being disposed between the front end and the rear end in communication therewith, the front end and the rear end being made of metal material, the flexible section being made of one of plastic material and polymer material, a heat transfer chamber being defined in the main body, the heat transfer chamber extending from the front end through the flexible section to the rear end; and a multi-segment floating adjustment unit having multiple adjustment members disposed on an outer surface of the flexible section for restricting and protecting the flexible section, each of two ends of each adjustment member having a pivoted section for pivotally connecting the adjustment members with each other so as to string the adjustment members to form the multi-segment floating adjustment unit, wherein at least one of the pivoted sections comprises a pivot hole that receives a pivot shaft of an adjacent one of the pivoted sections, whereby by means of the pivoted sections, the adjustment members can be swung and bent by the same angle or by different angles to adjust the arrangement of the multi-segment floating adjustment unit.

2. The hetero-material floating heat pipe structure as claimed in claim 1, wherein the polymer material is selected from a group consisting of polypropylene, polyethylene, polystyrene, polyimide and polyethylene terephthalate.

3. The hetero-material floating heat pipe structure as claimed in claim 1, wherein the front end has a front end inner space and the rear end has a rear end inner space, while the flexible section has a flexible inner space, the front end inner space, the rear end inner space and the flexible inner space being in communication with each other to form the heat transfer chamber, a first capillary structure being disposed in each of the front end inner space and the rear end inner space, a second capillary structure being disposed in the flexible inner space, a working liquid being filled in the heat transfer chamber.

* * * * *